US006202439B1

(12) United States Patent
Mikheev et al.

(10) Patent No.: US 6,202,439 B1
(45) Date of Patent: Mar. 20, 2001

(54) DILUTION REFRIGERATOR

(75) Inventors: Vladimir Andreyevich Mikheev; Jeremy Philip White, both of Oxon; Timothy John Foster, Oxford; Graham John Batey, Oxon, all of (GB)

(73) Assignee: Oxford Instruments (UK) Limited, Oxon (GB)

( * ) Notice: Subject to any disclaimer, the term of this patent is extended or adjusted under 35 U.S.C. 154(b) by 0 days.

(21) Appl. No.: 09/343,224

(22) Filed: Jun. 30, 1999

(30) Foreign Application Priority Data

Jul. 3, 1998 (GB) ..... 9814546

(51) Int. Cl.[7] ..... F25B 9/12
(52) U.S. Cl. ..... 62/610; 62/51.1
(58) Field of Search ..... 62/610, 51.1, 51.2, 62/51.3, 50.7

(56) References Cited

U.S. PATENT DOCUMENTS 5,542,256 * 8/1996 Batey et al. ..... 62/610
5,816,071 * 10/1998 Pekola ..... 62/610

* cited by examiner

*Primary Examiner*—William Doerrler

(57) ABSTRACT

A dilution refrigerator includes a still; a mixing chamber; a pump to pump coolant from the still through a still outlet port and a heat exchanger connected between the still and mixing chamber whereby coolant flows under the assistance of the pump from the still to the mixing chamber and from the mixing chamber to the still through respective first and second adjacent paths in the heat exchanger. An access path extends to the mixing chamber. A probe is provided for insertion along the access path, the probe having a displacer which substantially fills the cross-section of the access path in use. Any coolant from the mixing chamber which flows along the access path past the displacer can flow from the access path into the still. The still outlet port is separate from the access path.

18 Claims, 3 Drawing Sheets

DILUTION REFRIGERATOR

FIELD OF THE INVENTION

The invention relates to a dilution refrigerator.

DESCRIPTION OF THE PRIOR ART

Dilution refrigerators are used for achieving ultra low temperatures for experiments in the millikelvin temperature range. A typical dilution refrigerator includes a still, a mixing chamber, and a heat exchanger connected between the still and mixing chamber whereby coolant flows from the still to the mixing chamber and from the mixing chamber to the still through respective first and second adjacent paths in the heat exchanger. Examples of known dilution refrigerators are described in U.S. Pat. No. 5,189,880, "A Simple Dilution Refrigerator" by J. L. Levine, The Review of Scientific Instruments, Vol. 43, Number 2, February 1972, pages 274–277, "Fully portable, highly flexible dilution refrigerator systems for neutron scattering", Hilton et al, Revue de Physique Appliquee, Vol. 19, No. 9, pages 775–777, and GB-A-2166535.

Typically, such a dilution refrigerator uses $^3$He/$^4$He and makes use of the fact that when a mixture of these two stable isotopes of helium is cooled below its tri-critical temperature, it separates into two phases. The lighter "concentrated phase" is rich in $^3$He and the heavier "dilute phase" is rich in $^4$He. Since the enthalpy of the $^3$He in the two phases is different, it is possible to obtain cooling by "evaporating" the $^3$He from the concentrated phase into the dilute phase.

The properties of the liquids in the dilution refrigerator are described by quantum mechanics. However, it is useful to regard the concentrated phase of the mixture as liquid $^3$He, and the dilute phase as $^3$He gas. The $^4$He which makes up the majority of the dilute phase is inert, and the $^3$He "gas" moves through the liquid $^4$He without interaction. This gas is formed in the mixing chamber at the phase boundary, in a process analogous to evaporation at a liquid surface. This process continues to work even at the lowest temperatures because the equilibrium concentration of $^3$He in the dilute phase is still finite, even as the temperature approaches absolute zero.

In a continuously operating system, the $^3$He must be extracted from the dilute phase (to prevent it from saturating) and returned into the concentrated phase, keeping the system in a dynamic equilibrium. The $^3$He is pumped away from the liquid surface in the still, which is typically maintained at a temperature of 0.6 to 0.7 K by a small heater. At this temperature the vapour pressure of the $^3$He is about 1000 times higher than that of $^4$He, so $^3$He evaporates preferentially.

The concentration of $^3$He in the dilute phase in the still therefore becomes lower than it is in the mixing chamber, and the osmotic pressure difference drives $^3$He to the still. The $^3$He leaving the mixing chamber is used to cool the returning flow of concentrated $^3$He in the heat exchanger. A room temperature vacuum pumping system draws the $^3$He gas from the still, and compresses it to a pressure of a few hundred millibar. The gas is then returned to the refrigerator.

In 1987, a modified dilution refrigerator was described which allowed the investigation of samples in high magnetic fields. See "Novel Top-Loading 20 mK/15T Cryomagnetic System" by P. H. P. Reinders et al, Cryogenics 1987 Vol. 27 December, pages 689–692. This type of dilution refrigerator is now known as a top loading dilution refrigerator.

Top loading dilution refrigerators have been developed for simple and rapid sample changing for millikelvin experiments without the need to warm up the main cryostat. A common approach is to have a top loading probe which is loaded into the cryostat through a room temperature vacuum lock. The cryostat is then kept at a temperature of 4.2K (or below) during this loading procedure, and the experiment or sample is mounted on the end of the probe. Using this technique, the experiment or sample can be loaded directly into the $^3$He/$^4$He mixture inside the mixing chamber. Quite often, the mixing chamber has a tubular extension into the bore of a magnet, allowing samples to be run at millikelvin temperatures in high magnetic fields as described in the Reinders et al paper. Another example of a top loading dilution refrigerator is described in EP-A0675330.

The problem with top loading into the mixing chamber is that it is necessary to provide a clear access tube into the mixing chamber. This access tube fills up with liquid $^3$He/$^4$He. It is therefore necessary to include a displacer on the probe to minimise the cross-sectional area of the liquid column in the central access tube. However, even with a displacer, there is a significant heat leak through the liquid around the displacer and this limits the base temperature.

In "A combined $^3$He-$^4$He dilution refrigerator" by V. N. Pavlov et al, Cryogenics, February 1978, pages 115–119, a route is provided to allow any coolant which flows up the access path to flow into the still. Thus when the displacer is removed, the system of heat exchangers is shunted by the access path and the refrigerator becomes a conventional $^3$He circulating refrigerator.

In the system of Pavlov, the probe passes down the pumping line into the still. A problem with the system of Pavlov is that a film of superfluid $^4$He will flow up the pumping line due to the temperature gradient (since superfluid $^4$He flows from low temperature regions to high temperature regions). The film will then progress up the pumping line until it evaporates. The evaporation of $^4$He impairs the cooling efficiency of the refrigerator and as a result a very powerful pump must be used.

Superfluid $^4$He films can only have a thickness up to a fundamental limit of approximately 200 Angstroms. Therefore one approach to the problem of film flow in Pavlov would be to reduce the diameter of the pumping line. However this would then limit the diameter of the probe (since the probe must be passed down the pumping line into the still).

SUMMARY OF THE INVENTION

In accordance with the a first aspect of the present invention there is provided a top loading dilution refrigerator comprising a still; a mixing chamber; a pump for pumping coolant from the still through a still outlet port; a heat exchanger connected between the still and mixing chamber whereby coolant flows under the assistance of the pump from the still to the mixing chamber and from the mixing chamber to the still through respective first and second adjacent paths in the heat exchanger; means defining an access path extending to the mixing chamber; a probe for insertion along the access path, the probe having a displacer which substantially fills the cross-section of the access path in use; and means to allow any coolant from the mixing chamber which flows along the access path past the displacer to flow from the access path into the still, characterised in that the still outlet port is separate from the access path.

In accordance with a second aspect of the present invention there is provided a dilution refrigerator comprising a still; a mixing chamber; a pump for pumping coolant from the still through a still outlet port; a heat exchanger connected between the still and mixing chamber whereby coolant flows under the assistance of the pump from the still to the mixing chamber and from the mixing chamber to the still through respective first and second adjacent paths in the heat exchanger; means defining an access path extending to the mixing chamber; a probe mounted in the access path, the probe having a displacer which substantially fills the cross-section of the access path; and means to allow any coolant from the mixing chamber which flows along the access path past the displacer to flow from the access path into the still, characterised in that the still outlet port is separate from the access path.

We have recognised that by physically separating the still outlet port from the access path, film flow through the still outlet port can be controlled without affecting the diameter of the access path.

Furthermore, we have also recognised the advantages inherent in providing a route for coolant to flow from access path into the still. We accept that we cannot displace all the coolant in the access path and there will always be at least a thin film around the displacer which will transmit heat from the still to the mixing chamber. We generate a flow of $^3$He atoms from the mixing chamber to the still flowing along the access path around the displacer. The heat load mechanism is complex but heat is primarily transported by the gas atoms, typically $^3$He dissolved in $^4$He, and convection instabilities in the liquid column. The heat flow from the still to the mixing chamber is greatly reduced (compared to a conventional static column) by this small flow from the mixing chamber to the still past the displacer. This advantage was not recognised by Pavlov et. al, who merely provided the flow route from the access path to the still to enable the refrigerator to work as a normal $^3$He circulating refrigerator when the probe is removed. The flow is induced by having a connection from the still into the access path. The relative flow through the conventional flow path, compared to the access path route, depends on the relative impedance of the two routes. It is important that the bulk of the flow passes through the conventional dilution refrigerator route as this provides the cooling power, while a small flow is generated up the access path to minimise the heat leak. To control the flow through the access path, the displacer is preferably a tight fit in the access path.

The coolant may flow from the access path into the still via the second path in the heat exchanger. However preferably the coolant flows from the access path directly into the still.

The invention is applicable to several different types of top loading dilution refrigerator. For example, the Reinders et al paper discloses a dilution refrigerator with a metallic dilution unit in which the still is laterally offset from the access tube. In this case, the means to allow coolant to flow into the still will comprise a conduit extending from the access path to the still.

In other applications, the still and heat exchanger are mounted coaxially with the access path as, for example, in EP-A-0675330, and the means can comprise a simple aperture in the wall of the access tube (which defines the access path).

The aperture or conduit can communicate with the still or the second path in the heat exchanger at a point below the coolant level in the still. However preferably the coolant flows from the access path into the still at a point above the level of coolant in the still.

In the first aspect of the invention, the probe is inserted, in use, along the access path (typically after the refrigerator has been pre-cooled). The probe may provide experimental services to a sample which has been previously mounted (either via the access path or be some other route) in the mixing chamber. For instance the probe may comprise a drive rod which is inserted along the access path, attached to the sample in the mixing chamber, and rotated to rotate the sample in the mixing chamber. Alternatively the probe may comprise a waveguide which transmits radiation to the sample. However preferably the probe comprises a sample holding device which is inserted along the access path to introduce the sample into the mixing chamber. In this case electrical wiring for connection to the sample may extend along the sample holding device.

Preferably, the probe is removable from the dilution refrigerator without purging coolant and in that case, the probe further comprises a seal for sealing the probe to the refrigerator when inserted. Preferably the seal is defined by a cone shaped member, located in the dilute or concentrated mixture, which mates with a corresponding cone shaped portion on the refrigerator.

In the second aspect of the invention, the probe is permanently mounted in the access path and the sample is introduced to the mixing chamber via some other route. Again, the probe may be used to rotate the sample or to transmit radiation to the sample.

In the preferred example, the access path extends through the centre of the heat exchanger.

In the case of pulsed magnetic fields, it is preferable if all the components making up the still, heat exchanger and mixing chamber are made of non-metallic materials such as plastics, preferably PEEK. PEEK (polyetheretherketone) is particularly suitable because it has low diffusibility to helium gas, even at room temperature (300K) for the time periods required for conventional dilution unit leak testing. This simplifies leak testing procedures.

Preferably, the probe is sealed to the heat exchanger, for example by a seal comprising cooperating cone shaped members on the probe and heat exchanger. Other seals could be used such as cooperating screw shaped members.

Film flow may simply be restricted by providing a pumping path (which terminates at the still outlet port) with a small diameter. However this increases the fluid impedance of the pumping path which can result in a more powerful pump being required. Therefore in a preferred example a film flow restrictor is provided to restrict the flow of coolant film through the still outlet port without significantly increasing the fluid impedance presented to the pump. For example the walls defining the still outlet port may be coated with a material (such as pure Caesium) which repels the liquid coolant film. Alternatively the cross-sectional area of the pumping path may reduce to an orifice at the still outlet port. The relatively small diameter of the pumping path at the orifice restricts the film flow, but does not significantly increase the impedance of the pumping path. Preferably the length of pumping path with relatively small cross-sectional area is minimised by tapering the walls defining the orifice to a knife-edge. In a further alternative, a film burner may be provided at the still outlet port. An example of a suitable film burner is described by G. Frossati in J. de Physique 39 (C6), 1578 (1978); and J. Low Temp. Phys. 87, 595 (1992).

BRIEF DESCRIPTION OF THE DRAWINGS

An example of a dilution refrigerator incorporating a probe according to the invention will now be described with reference to the accompanying drawings, in which.

DETAILED DESCRIPTION OF THE EMBODIMENTS

Figure 1:
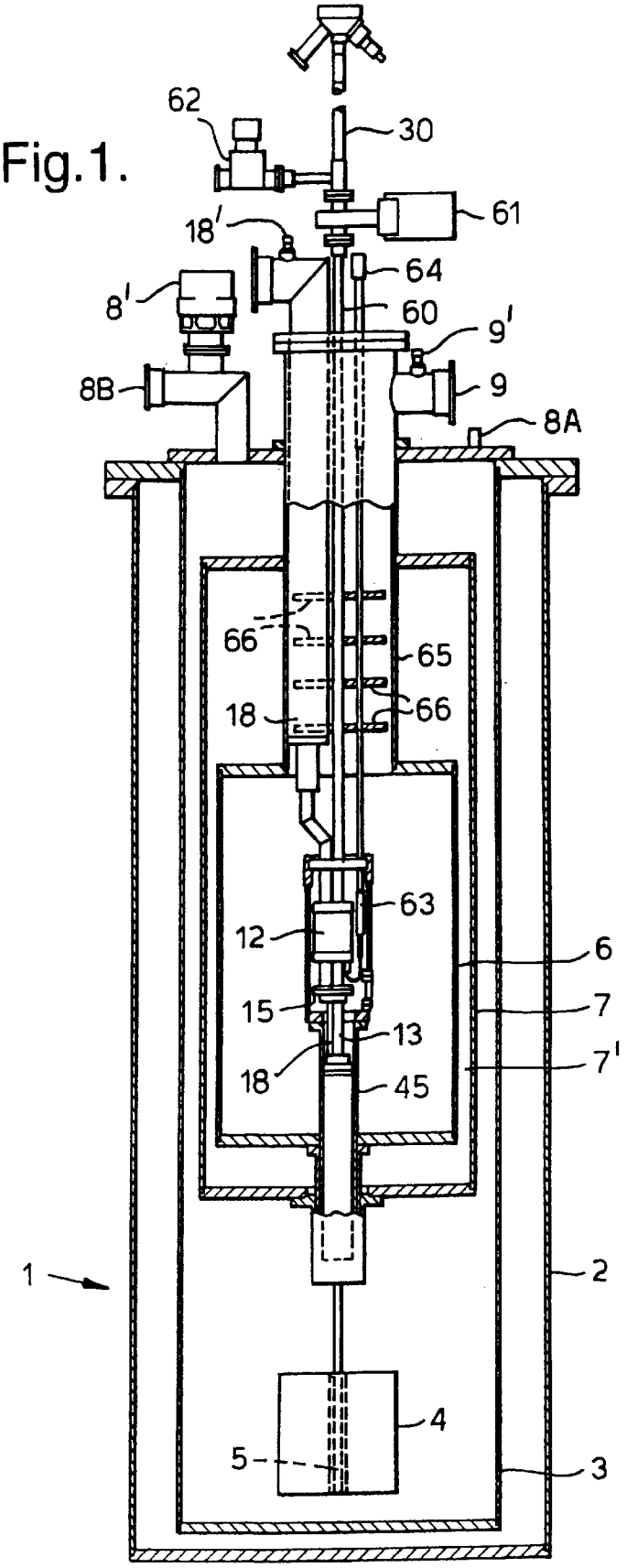
FIG. 1 is a schematic, partially cut away view of the dilution refrigerator situated within a cryostat containing a magnet.

The apparatus shown in FIG. 1 comprises a cryostat 1 having a cylindrical outer wall 2, radially inwardly of which is mounted a cylindrical wall 3 with a vacuum defined in the space between the walls 2,3. The wall 3 defines a chamber filled with liquid nitrogen and containing a magnet 4 having a bore 5. Axially positioned above the magnet 4 within the liquid nitrogen reservoir is a cylindrical liquid helium reservoir 6 separated from the liquid nitrogen reservoir by an evacuated region 7' defined between the reservoir 6 and a wall 7. An inner vacuum vessel 45 is positioned within the reservoir 6. Conventional ports 8A,8B are coupled with the liquid nitrogen reservoir for supplying and exhausting nitrogen respectively and similar ports 9 (only one shown) are provided for the helium reservoir 6. Each port 8B and 9 has an associated pressure relief valve 8', 9' respectively.

A dilution refrigerator is inserted along a central axis of the cryostat 1. The dilution refrigerator is generally of the form described in EP-A-0675330 and is shown in more detail in FIG. 2. The refrigerator includes a plastics machined cylinder 10 defining a central cylindrical bore or access tube 11 which defines a probe access path. The cylinder 10 is connected to a 1K pot of conventional form 12 (FIG. 1) via a metal tube 13 located on a tubular extension 14 of the cylinder 10. The tube 13 is bonded to the 1K pot 12 by an indium seal flange 15. A tube 60 extends from the top of the 1K pot 12 in alignment with the tube 13 to a gate valve 61 above which is positioned a vacuum lock 62 for connection to a vacuum pump (not shown).

The 1K pot 12 is filled with helium from the reservoir 6 via a needle valve 63 which is connected via a tube (not shown) with the reservoir 6 on one side and to the 1K pot 12 on the other side. The needle valve 63 is controlled from a control position 64 external to the refrigerator.

The upper end of the cylinder 10 defines an upwardly opening, cylindrical bore 16 forming the still which is closed by a plug 17 into which extends a tube 18 defining a still pumping path which terminates at a still outlet port 113, and electrical wiring contained in a tube 19. A 5–6 mm diameter aperture 100 extends through the inner wall of the still 16 into the bore 11 below the still outlet port 113. The aperture 100 is shown above the liquid level in the still but it can also be below the liquid level.

The tube 18, tube 60, and control 64 extend through a neck 65 of the reservoir 6 and four radiation baffles 66 are positioned within the neck 65. Each baffle has a small clearance (4–5 mm) between its circumference and the facing surface of the neck 65.

As will be explained below, $^3$He is pumped along the pumping path 18 (having a pressure relief valve 18') out of the still 16 by a pump (indicated schematically at 210) and is returned to a conduit 20 which extends into a helical groove 21 extending around the plastics cylinder 10. The conduit 20 terminates in a mixing chamber 22 in another plastics cylinder 23 having a socket 24 into which the end of the cylinder 10 is received. A tube extension 46 is provided in the mixing chamber 22. A non-metallic tube 25 extends around the groove 21 and part of the cylinder 23. The groove 21 and conduit 20 cooperate together to define a heat exchanger 26.

A member 27 defines an elongate extension tail of the mixing chamber 22 and is situated in use in the bore 5 of the magnet 4 as shown in FIG. 1. Typically, the clear diameter of the bore 5 would be about 15 mm although the diameter of the access tube can be as high as 34 mm.

Figure 2:
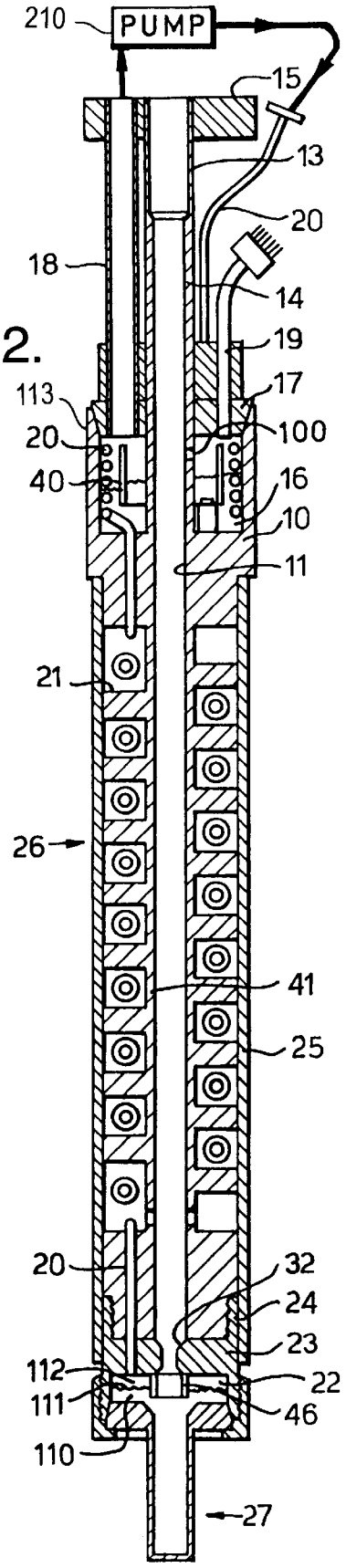
FIG. 2 illustrates the components of the dilution refrigerator in more detail.
Figure 3:
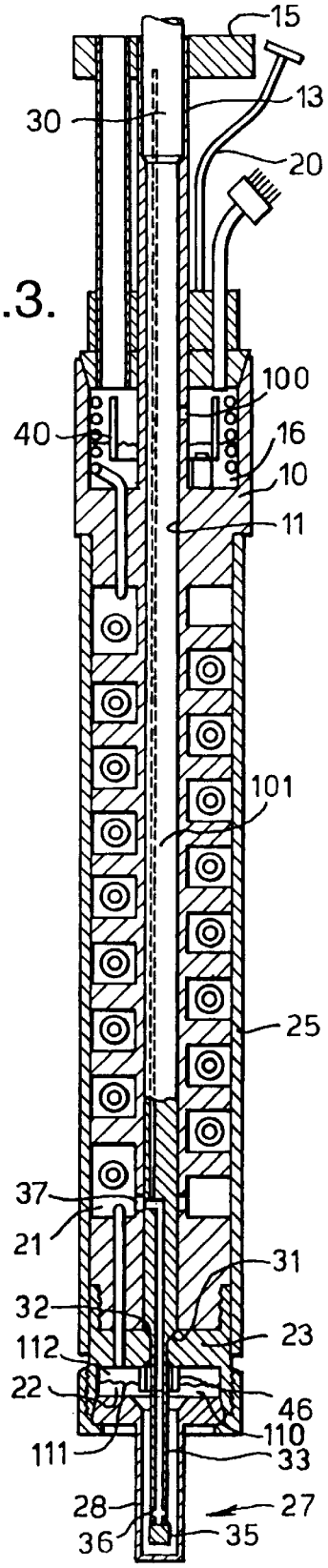
FIG. 3 illustrates the dilution refrigerator shown in FIG. 2 with a probe inserted.

FIG. 3 illustrates the dilution refrigerator of FIG. 2 but with a probe inserted. The probe is indicated at 30 and comprises a plastics cylinder forming a displacer 101 which extends as a tight fit through the bore 11 of the plastics cylinder 10. The end of the probe 30 has towards its lower end a cone shaped cold seal 31 which sits in a correspondingly shaped seat 32 defined by the plastics cylinder 23. A narrower section 33 of the probe 30 extends through the mixing chamber 22 and terminates near the bottom of the extension tail 27. A sample 35 is secured to the lower end of the section 33 as described in EP-A0675330.

The lower section 33 of the probe 30 also includes a number of orifices 36 circumferentially spaced around the section 33 to allow $^3$He to pass into the section 33. The passage in the section 33 terminates in a radially opening orifice 37 which communicates in use with the groove 21 in the heat exchanger (See FIG. 3).

Typically, the inside diameter of the tubular section 33 is about 2 mm. Electrical wiring (not shown) may extend through this section 33 for connection to the sample.

The operation of the dilution refrigerator can be briefly explained as follows. The mixing chamber 22 includes a mixture 110 of $^3$He and $^4$He. There exists a phase boundary 111 within the mixing chamber and $^3$He gas is "evaporated" from a "concentrated phase" 112 into the dilute phase 110 defined principally by $^4$He. The $^3$He "gas" then moves through the liquid $^4$He down into the tail 27, through the apertures 36 and up through the tubular section 33 of the probe 30. The primary flow of $^3$He/$^4$He is then into the groove 21 of the heat exchanger 26. This $^3$He/$^4$He then moves up through the helical groove 21 into the still 16 from where the $^3$He is pumped through the tube 18 and back in concentrated form to the return line 20. The relatively small diameter of the tube 18 ensures that only a small amount of superfluid $^4$He flows up the sides of the tube. This reduces the concentration of $^4$He in the vapour passing up the tube 18. Furthermore, the diameter of the access tube 11 can be increased without increasing the concentration of $^4$He in the vapour passing up the tube 18. The $^3$He is maintained at a temperature of 0.6 to 0.7K in the still 16 by a heater 40. The returned $^3$He passes through the conduit 20 within the groove 21 where it is cooled by the $^3$He leaving the mixing chamber 22 until it is fed into the mixing chamber 22 and the cycle continues.

Some $^3$He/$^4$He will leak past the cold seal 31 into the bore 11 of the moulding 10. Traditionally, this has been ignored on the basis that the impedance of this path is much greater than that of the flow from still through heat exchanger to mixing chamber and so this leak path will not adversely affect the refrigerators performance. The wall of the heat exchanger 26 adjacent the helical groove 21, for example at 41, is made sufficiently thin so that heat exchange can take place between the liquid and probe in the central bore 11 and liquid within the groove 21.

In the present invention, however, this path is promoted by use of the aperture 100. The presence of this aperture generates an osmotic pressure as a result of the concentration gradient in the $^3He/^4He$ so producing a positive flow through the bore 11 past the displacer 101. In view of the tight fit of the displacer 101 in the bore 11, this flow is small compared to the primary flow along the tube 21 but we have found that it can be made sufficient to reduce significantly the heat leak from the still 16 to the mixing chamber 22. The $^3He$ atoms dissolved in $^4He$ flowing away from the mixing chamber greatly reduce the heat flow from the still to the mixing chamber.

The reason for the tube extension 46 is that if the phase boundary between the dilute and concentrated phases is set up correctly, any "crossover" leak occurring at the cone seal would still cause $^3He$ to cross the phase boundary thereby creating cooling. Without the extension tube a crossover leak would cause the $^3He$ just to be taken from the concentrated phase without forcing it to cross the phase boundary.

The embodiment described in FIGS. 1–3 is a special non-metallic top loading system as described in EP-A0675330. However the invention can also be employed in a conventional metal top loading dilution refrigerator.

Furthermore, although a top loading refrigerator is described, it will be appreciated that the invention is also applicable to a system in which the probe is permanently mounted in the access path.

In an alternative embodiment, instead of providing an aperture 100 which allows the coolant to flow directly from the access path into the still 16, an aperture may be provided in the wall of the heat exchanger 26 adjacent the helical groove 21 (for example at 41) so that the coolant flows from the access path to the still via the helical groove 21.

Figure 4:
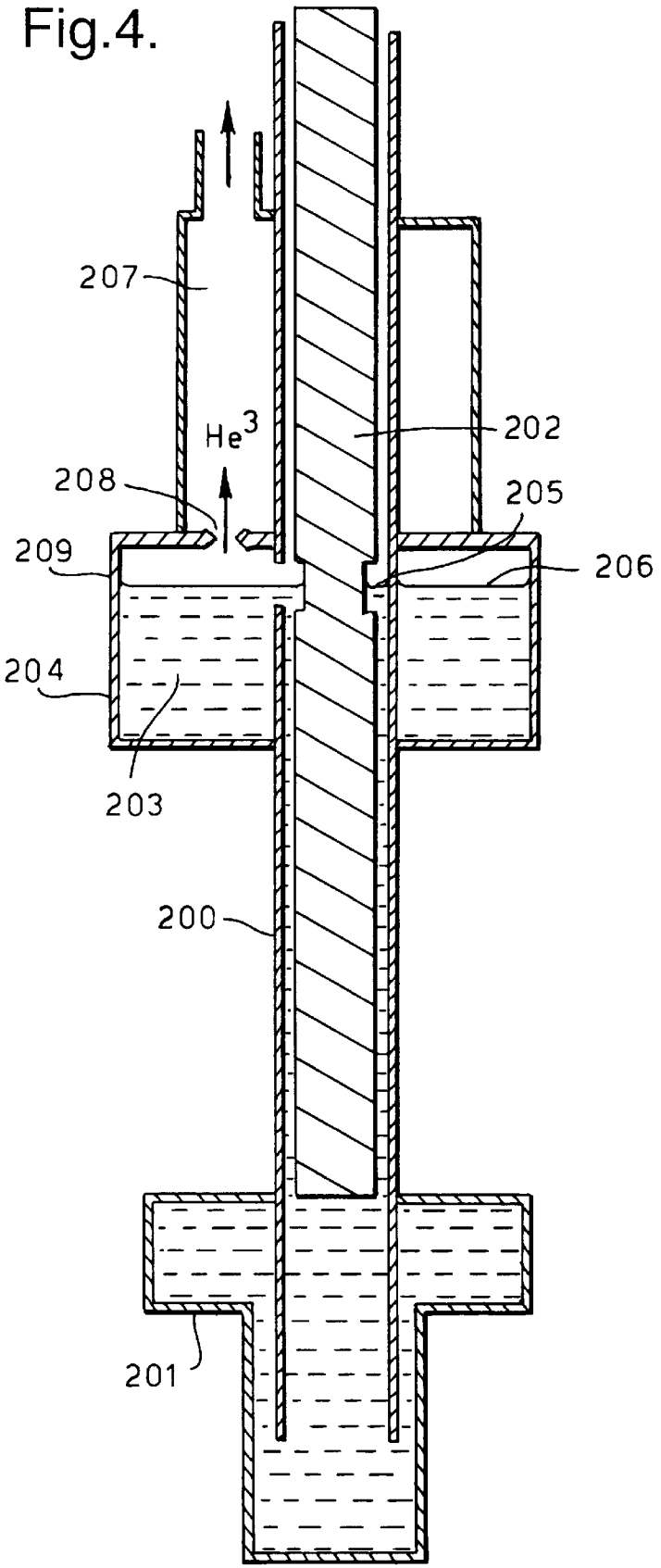
FIG. 4 is a schematic view of an alternative dilution refrigerator with a probe inserted.

A further alternative embodiment of a dilution refrigerator according to the present invention is illustrated schematically in FIG. 4. The heat exchanger and return flow path from the pump to the still are omitted for clarity. An access tube 200 extends into a mixing chamber 201. A displacer 202 is inserted into the access tube 200. $^3He$ flows up the access tube 200 outside the displacer 202 and into a still 204 through a 5–6 mm diameter hole 203 in the side of the access tube 200, the hole 203 being located in alignment with the liquid level 206 in the still 204. A groove 205 is provided around the circumference of the displacer 202 at the level of the hole 203 to ensure that all of the fluid flowing up the access tube 200 flows through the hole 203. A pumping path 207 to a pump (not shown) narrows to an orifice 208 which forms the still outlet port. The wall 209 defining the orifice 208 is tapered to a knife-edge as shown, to minimise the fluid impedance of the orifice 208 and maximise its film restricting effect.

We claim:

1. A dilution refrigerator comprising:

a still;

a mixing chamber;

a pump to pump coolant from the still through a still outlet port;

a heat exchanger connected between the still and mixing chamber whereby coolant flows under the assistance of the pump from the still to the mixing chamber and from the mixing chamber to the still through respective first and second adjacent paths in the heat exchanger;

means for defining an access path extending to the mixing chamber, wherein the means for defining an access path comprises an access tube which extends through the still;

a probe to insert along the access path, the probe having a displacer which substantially fills the cross-section of the access path in use; and means for allowing any coolant from the mixing chamber which flows along the access path past the displacer to flow from the access path into the still, wherein the still outlet port is separate from the access path and wherein the means for allowing coolant to flow from the access path into the still comprises an aperture extending through the access tube.

2. A refrigerator according to claim 1, wherein the means for allowing coolant to flow from the access path into the still includes a conduit.

3. A dilution refrigerator according to claim 1, wherein the still, heat exchanger and mixing chamber are coaxially arranged.

4. A dilution refrigerator according to claim 1, the coolant comprising $^3He$ and $^4He$.

5. A dilution refrigerator according to claim 1, wherein the coolant flows from the access path directly into the still.

6. A dilution refrigerator according to claim 1, further comprising a film flow restrictor which restricts the flow of coolant film through the still outlet port.

7. A dilution refrigerator according to claim 6, further comprising means for defining a pumping path between the still outlet port and the pump, wherein the cross-sectional area of the pumping path reduces to an orifice at the still outlet.

8. A dilution refrigerator according to claim 7, wherein the orifice is defined by walls which taper to a knife-edge.

9. A dilution refrigerator comprising:

a still;

a mixing chamber;

a pump to pump coolant from the still through a still outlet port;

a heat exchanger connected between the still and mixing chamber whereby coolant flows under the assistance of the pump from the still to the mixing chamber and from the mixing chamber to the still through respective first and second adjacent paths in the heat exchanger;

means for defining an access path extending to the mixing chamber, wherein the means for defining an access path comprises an access tube which extends through the still;

a probe mounted in the access path, the probe having a displacer which substantially fills the cross section of the access path; and means for allowing any coolant from the mixing chamber which flows along the access path past the displacer to flow from the access path into the still, wherein the still outlet port is separate from the access path and wherein the means for allowing coolant to flow from the access path into the still comprises an aperture extending through the access tube.

10. A refrigerator according to claim 9, wherein the means for allowing coolant to flow from the access path into the still includes a conduit.

11. A dilution refrigerator according to claim 9, wherein the still, heat exchanger and mixing chamber are coaxially arranged.

12. A dilution refrigerator according to claim 9, the coolant comprising $^3He$ and $^4He$.

13. A dilution refrigerator according to claim 9, wherein the coolant flows from the access path directly into the still.

14. A dilution refrigerator according to claim 9, further comprising a film flow restrictor which restricts the flow of coolant film through the still outlet port.

15. A dilution refrigerator according to claim 14, further comprising means for defining a pumping path between the still outlet port and the pump, wherein the cross-sectional area of the pumping path reduces to an orifice at the still outlet.

16. A dilution refrigerator according to claim 15, wherein the orifice is defined by walls which taper to a knife-edge.

17. A method of operating a dilution refrigerator according to claim 1, the method comprising pumping coolant through the still outlet port whereby coolant flows separately via the access path from the still to the mixing chamber, and from the mixing chamber to the still through the respective first and second adjacent paths in the heat exchanger; and allowing any coolant from the mixing chamber which flows along the access path past the displacer to flow from the access path into the still.

18. A method of operating a dilution refrigerator according to claim 9, the method comprising pumping coolant through the still outlet port whereby coolant flows separately via the access path from the still to the mixing chamber, and from the mixing chamber to the still through the respective first and second adjacent paths in the heat exchanger; and allowing any coolant from the mixing chamber which flows along the access path past the displacer to flow from the access path into the still.

* * * * *